United States Patent [19]

Lewis

[11] 4,095,833

[45] Jun. 20, 1978

[54] SWIVEL-MOUNTED PNEUMATIC-CONTROLLED RELEASING HOOK DEVICE

[75] Inventor: Charles B. Lewis, Milwaukie, Oreg.

[73] Assignee: Cranston Machinery Company, Inc., Oak Grove, Oreg.

[21] Appl. No.: 742,891

[22] Filed: Nov. 18, 1976

[51] Int. Cl.[2] ..... B66C 1/38

[52] U.S. Cl. ..... 294/83 R

[58] Field of Search ..... 294/83 R, 83 AB, 86.15, 294/82 R, 78 R; 24/230.5 R, 241, 232, 242; 59/93, 95

[56] References Cited

U.S. PATENT DOCUMENTS

| | | | |
|---|---|---|---|
| 4,007,957 | 2/1977 | Roden | 24/232 R |
| 4,034,992 | 8/1977 | Epstein | 294/83 R |
| 4,039,219 | 8/1977 | Bagman | 294/82 R |

*Primary Examiner*—James B. Marbert

*Attorney, Agent, or Firm*—Lee R. Schermerhorn

[57] ABSTRACT

The hook portion of the device has unrestricted rotational freedom relative to a swivel connection for a suspension chain and air supply hose. The hook is released by the upward movement of a latch piston. To produce this release movement air pressure is introduced under the piston by an axial tube in the piston cylinder which penetrates the piston from the top while allowing both rotational and axial movements of the piston.

6 Claims, 7 Drawing Figures

FIG. 5
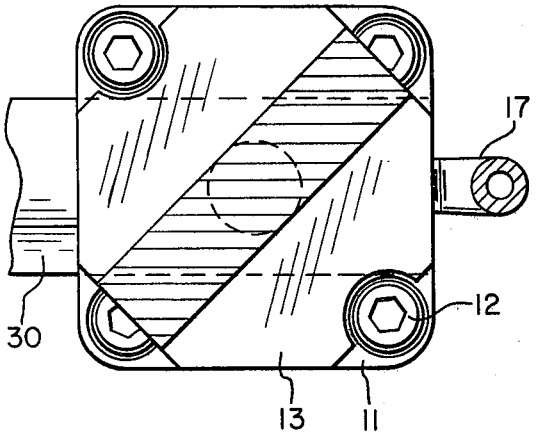
FIG. 4
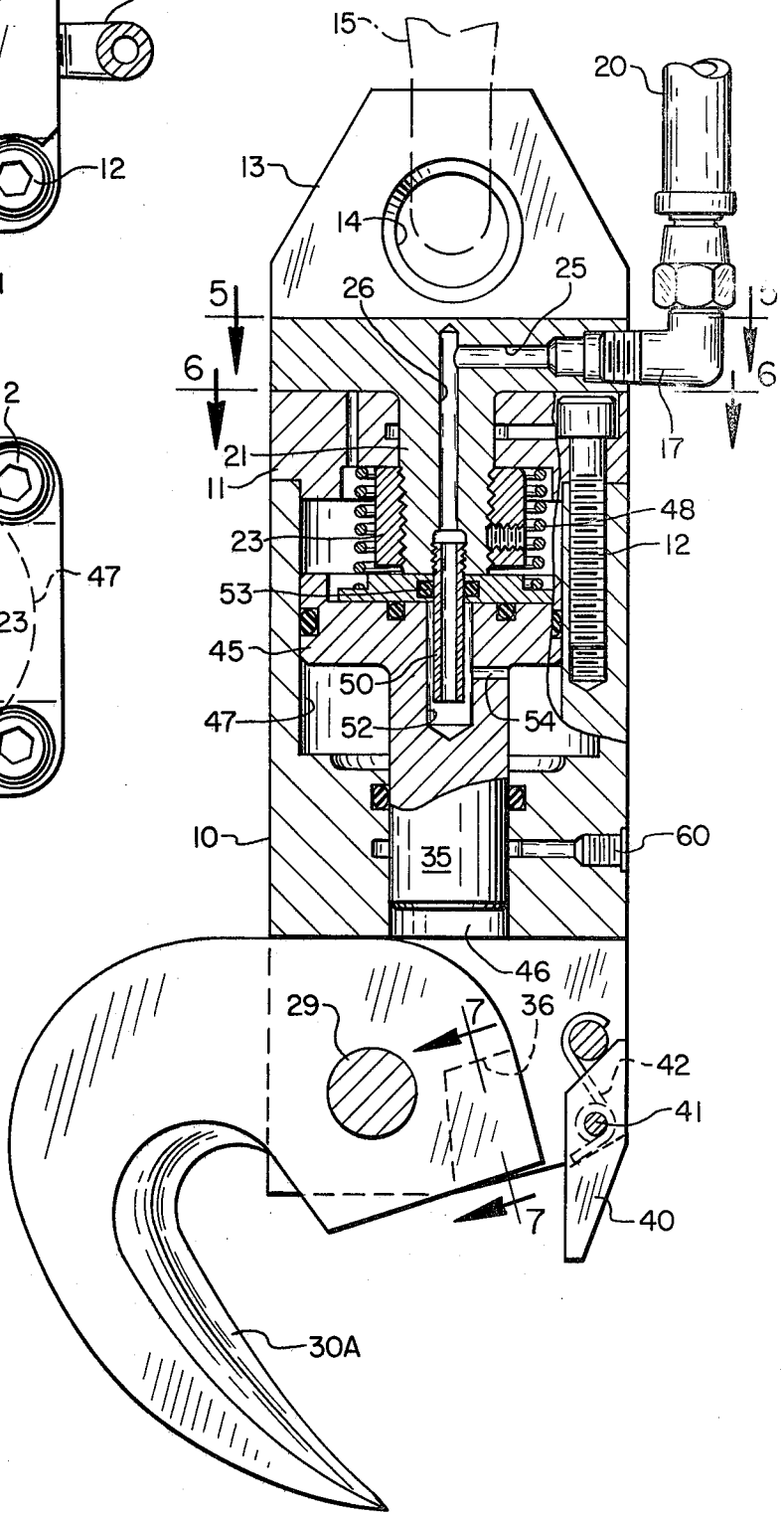
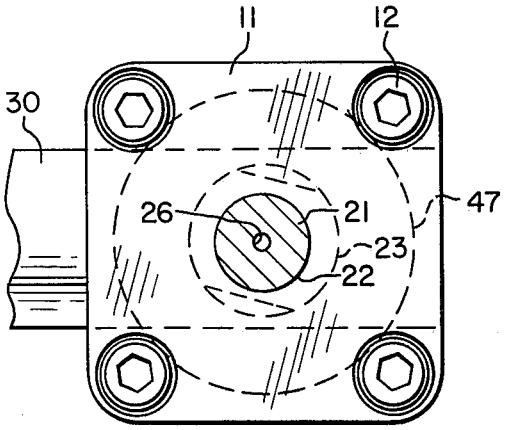
FIG. 6
FIG. 7
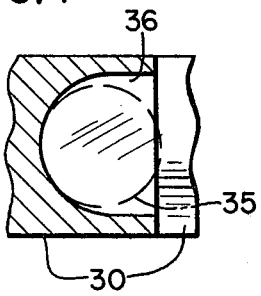

SWIVEL-MOUNTED PNEUMATIC-CONTROLLED RELEASING HOOK DEVICE

BACKGROUND OF THE INVENTION

This invention relates to a swivel-mounted pneumatic-controlled releasing hook device for lifting packages and other cargo.

Heavy packages are lifted by a group of wires, flat band straps or wire rope which has been placed around the package. The lifting hook or hooks are inserted under the package strapping by hand. Each hook is released from the package by remote control, by allowing air pressure to operate an internal latch piston.

Such hooks are commonly suspended in groups from a framework which in turn is lifted by a crane. The suspension means is normally and preferably alloy steel chain. When the hooks are to be attached a load, the suspension framework is set down on top of the load. This results in the hooks lying on the load with the suspension chain for each hook in a relaxed or loose mode.

In this position the suspension chains exibit no directional preference. The hooks may be inserted under the package strapping in either a left to right or right to left motion. However, a suspension chain may be twisted or straight depending on which way the hook is inserted. Once the crane begins lifting and the load is applied to the suspension chains, the chains exhibit a tendency to rotate to a straight, untwisted configuration. If a hook was inserted under the strapping in a direction which causes a twist in the chain, the untwisting tendency of the chain may cause a small safety latch on the hook to be torn off and allow the hook to rotate out from under the strapping causing the load to fall.

This deficiency cannot be overcome by merely putting a swivel in the chain because this allows unrestricted rotation of the hook, permitting the air supply hose to become twisted around the chain. This results in premature failure of the hose due to chafing or rupture due to stretching.

Objects of the present invention are, therefore, to provide an improved swivel-mounted pneumatic-controlled releasing hook device which overcomes the difficulties explained above, to provide such a device in which the hook portion has unrestricted rotational freedom relative to a suspension chain and air supply hose, and to provide a novel means for introducing air pressure under a latch piston which has an upward release movement while allowing both rotational and axial movement of the piston.

SUMMARY OF THE INVENTION

In the present construction a swivel having a lifting eye and air hose connection is mounted for rotation on one end of a body member. A hook is pivotally mounted on the other end of the body member for movement between a carrying position and release position. A latch piston normally engages the hook to hold the hook in carrying position.

The hook is released by upward movement of the latch piston. The release movement is produced by introducing air pressure under the piston by an axial tube in a cylinder for the piston, which tube penetrates the piston from the top while allowing both rotational and axial movements of the piston. Thus, the lifting chain and air supply hose for each hook device are never twisted during the lifting of the package with the desirable result that the air hose and safety latches are not subject to the damage hereinabove described and heavy packages are safely lifted.

The invention will be better understood and additional objects and advantages will become apparent from the following detailed description of the preferred embodiment illustrated in the accompanying drawings. Various changes may be made, however, in the details of construction and arrangement of parts and certain features may be used without others. All such modifications within the scope of the appended claims are included in the invention.

BRIEF DESCRIPTION OF THE DRAWINGS

FIG. 4 is a view similar to FIG. 2 showing the parts in release position.

FIG. 5 is a sectional view on the line 5—5 in FIG. 4.

FIG. 6 is a sectional view on the line 6—6 in FIG. 4.

FIG. 7 is a fragmentary view on the line 7—7 in FIG. 4.

DESCRIPTION OF THE PREFERRED EMBODIMENT

Figure 1:
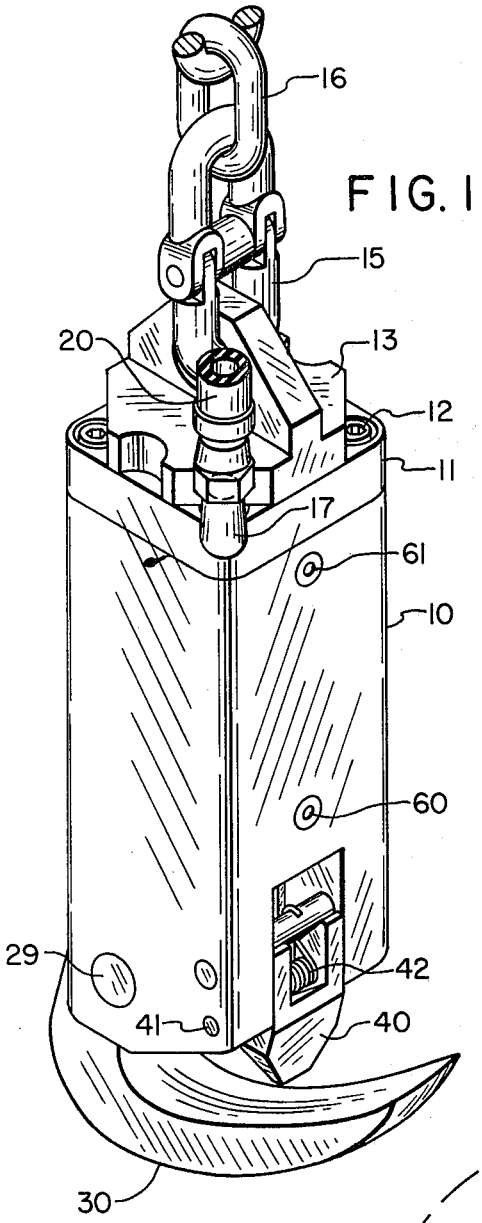
FIG. 1 is a perspective view of a hook device embodying the invention.
Figure 2:
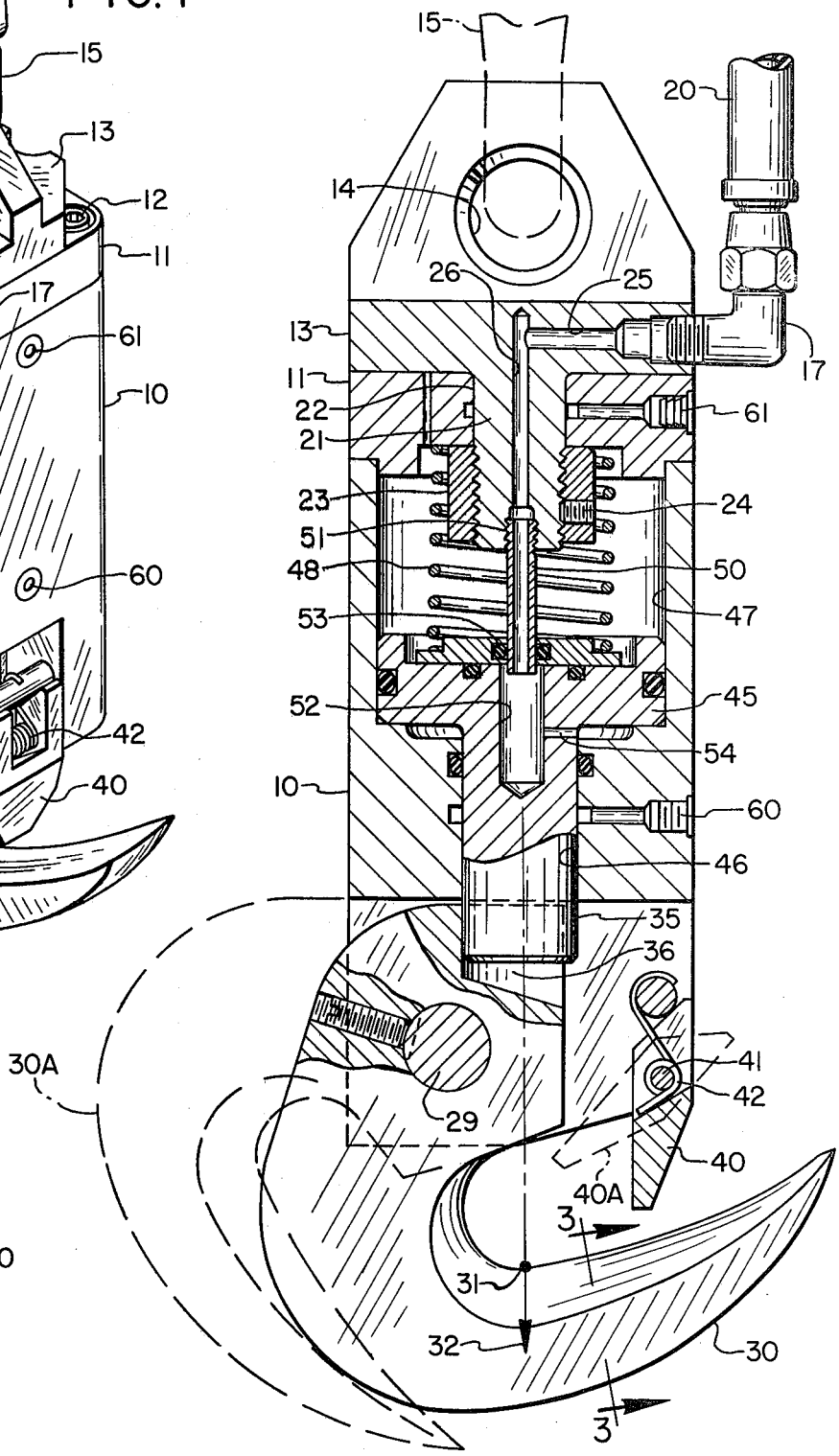
FIG. 2 is a vertical sectional view with certain parts broken away showing the hook in carrying position in solid lines.
Figure 3:
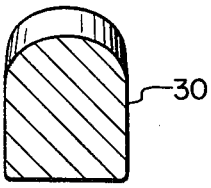
FIG. 3 is a view on the line 3—3 in FIG. 2.

Referring first to FIGS. 1 and 2, the present device comprises a vertical square body member 10 having a cap 11 secured on the upper end thereof by four vertical screws 12 in the corners of the body member. A swivel 13 is mounted on cap 11 for unlimited rotation by the vertical axis of body 10.

Swivel 13 has a lifting eye 14 to receive a clevis 15 on the lower end of a lifting chain 16. Swivel 13 is also equipped with a fitting 17 for connection with an air supply hose 20. Swivel 13 further includes a downwardly extending threaded stud 21 which is mounted for rotation in a hole 22 in cap 11. The swivel is secured to cap 11 by a nut 23 on the lower end of stud 21, the nut being locked on the stud by set screw 24. A horizontal passageway 25 communicates with a vertical passageway 26 in the stud to convey air pressure from hose 20 thru fitting 17 to vertical passageway 26.

A horizontal transverse pin 29 in the lower end of body member 10 provides pivotal support for lifting hook 30 which is inserted by hand under the strapping on a package to be lifted. When the device is in vertical lifting position as shown in FIGS. 1 and 2 the weight of the package causes the strapping to exert a downward vertical force at approximately point 31 on the hook as represented by arrow 32 in FIG. 2. The configuration of the hook is such that load point 31 and downward force vector 32 are disposed to the right side of the axis of pivot pin 29 whereby the weight of the load tends to pivot the hook to release position as indicated in broken lines at 30A.

A vertically movable latch pin 35 normally engages a recess 36 in an upper portion of the hook above pivot pin 29 to latch the hook in the load carrying position shown in solid lines in FIG. 2. When the hook is in load carrying position accidental disengagement of the package strapping from the hook is prevented by a safety latch 40 mounted on a horizontal pivot pin 41 in body 10. A coil spring 42 normally holds latch 40 in its solid line position substantially closing a gap between the lifting surface of hook 30 and the lower end of body member 10. When the hook is inserted under the package strapping the latch is pushed back to its broken line position at 40A and then springs back to its latching position at 40 to retain the strapping on the hook.

Latch pin 35 is a piston rod which is integral with a piston 45. Latch pin 35 slides in a cylindrical bore 46 in the lower end of body 10 and piston 45 slides in a cylindrical bore 47 in the body member. The latch pin and piston are pressed in a downward direction by a coil spring 48.

An air tube 50 transmits air pressure to the under side of piston 45 to raise the latch pin 35 and release the hook 30. The upper end of the air tube 50 has threaded engagement at 51 with the lower end of air passageway 26 in stud 21 on the axis of cylinder 57. The lower end of air tube 50 extends into a vertical bore 52 in the piston and piston rod. O-ring 53 provides a seal between the air tube and the piston which allows both rotational and reciprocating motions of the piston. Passageway 54 provides air flow communication between bore 52 and the lower end of cylinder 47 under the piston 45.

A lubrication fitting 60 lubricates the latch pin 35 and a lubrication fitting 61 lubricates the stud 21 on swivel 13.

Thus the swivel 13 allows unlimited rotation of body member 10 relative to lifting chain 16 and air supply hose 20 so that the chain will not become twisted and the air hose will not be twisted around the chain. The load on the hook is supported by nut 23 on stud 21.

In the absence of air pressure in air hose 20 the parts assume the positions shown in FIG. 2 with the hook latched in its solid line lifting position at 30 by the action of spring 48 on latch pin 35. Hook 30 may be inserted under the strapping on a package to be lifted without regard to the fact that such manipulation may twist the body member 10 relative to chain 16 and air hose 20. As soon as lifting force is exerted on chain 16 the swivel 13 rotates as may be necessary to relieve any twisting of the chain and air hose.

When the lifted package is deposited in a desired position, air pressure is admitted to air hose 20 by a remote control valve producing an air flow thru air tube 50 and passageway 54 to lift piston 45 and latch pin 35. Then a momentary tensioning of chain 16 pivots the hook 30 on pin 29 to release position at 30A disengaging the hook from the package strapping as shown in FIG. 4 and the crane may lift the hook clear of the package. When another package is to be lifted, the hook is manually returned to its lifting and latched position as indicated at 30 in solid lines in FIG. 2, the air pressure having been relieved from air hose 20 as soon as the hook has been released from its previous package.

What is claimed is:

1. A swivel-mounted pneumatic-controlled releasing hook device comprising a body, a swivel having a lifting eye mounted for rotation on one end of said body, an air line connection in said swivel, a hook pivotally mounted on the other end of said body for movement between a carrying position and a release position, a latch pin engageable with said hook to hold said hook in carrying position, a spring holding said latch pin in said engagement with said hook, a piston in said body for retracting said latch pin, and passageways for transmitting air pressure in said air line connection to said piston to retract said latch pin, said passageways including an air tube on said swivel extending axially through said piston, said piston being slidable and rotatable on said air tube.

2. A device as defined in claim 1, the axis of said swivel extending longitudinally of said body and the axis of said hook extending transversely of said body.

3. A device as defined in claim 2, the axis of said piston extending longitudinally of said body and said latch pin being an integral part of said piston.

4. A device as defined in claim 1 including a spring actuated pivotally mounted latch on said body arranged to prevent release of an article from said hook in said carrying position.

5. A swivel-mounted pneumatic-controlled releasing hook device comprising a body, a swivel having a lifting eye mounted for rotation on one end of said body, an air line connection in said swivel, a hook pivotally mounted on the other end of said body for movement between a carrying position and a release position, a latch pin engageable with said hook to hold said hook in carrying position, a spring holding said latch pin in said engagement with said hook, a piston in said body for retracting said latch pin, passageways for transmitting air pressure in said air line connection to said piston to retract said latch pin, a threaded stud on said swivel, an apertured cap on said body rotatably mounted on said stud, a nut on said stud supporting said cap and body, a cylinder for said piston in said body coaxial with said stud, and an axial air tube on said stud extending into said piston, said passageways in said swivel connecting said air tube with said air line connection.

6. A device as defined in claim 5, said spring being a coil spring in said cylinder surrounding said stud and said air tube with one end of the spring bearing against said cap and the other end bearing against said piston, said latch pin being an integral part of said piston.

* * * * *